US005788446A

United States Patent [19]

Stolz

[11] Patent Number: 5,788,446

[45] Date of Patent: Aug. 4, 1998

[54] METHOD AND APPARATUS FOR MAKING BOOKS, BROCHURES, AND SIMILAR PRODUCTS WITH PERFECT BINDING

[75] Inventor: Marcel Stolz, Felben, Switzerland

[73] Assignee: GRAPHA-Holding AG, Hergiswil, Switzerland

[21] Appl. No.: 556,008

[22] Filed: Nov. 13, 1995

[30] Foreign Application Priority Data

| | | | |
|---|---|---|---|
| Nov. 18, 1994 | [CH] | Switzerland | 479/94 |
| Dec. 14, 1994 | [CH] | Switzerland | 781/94 |

[51] Int. Cl.[6] ..... B42B 9/00

[52] U.S. Cl. ..... 412/9; 412/1; 412/33

[58] Field of Search ..... 412/3–6, 8–10, 412/17–23, 25, 28, 32, 33; 281/21.1; 270/52.14, 52.16; 271/204, 205, 69, 412; 198/470.1, 803.7; 269/237, 238, 239

[56] References Cited

U.S. PATENT DOCUMENTS

| | | | |
|---|---|---|---|
| 2,755,491 | 7/1956 | Terzuoli et al. | 412/22 |
| 3,633,727 | 1/1972 | Brenner | 412/10 |
| 3,927,873 | 12/1975 | Chambers | 269/237 |
| 4,467,912 | 8/1984 | Rathert | 198/803.7 |
| 4,512,457 | 4/1985 | Reist et al. | 271/205 |
| 4,896,874 | 1/1990 | Muller | 271/205 |
| 4,917,369 | 4/1990 | Moll et al. | 271/204 |
| 5,431,386 | 7/1995 | Blaser | 271/204 |

FOREIGN PATENT DOCUMENTS

| | | | |
|---|---|---|---|
| 666609 | 10/1929 | France | 412/21 |
| 1236038 | 6/1960 | France . | |
| 1077181 | 3/1960 | Germany | 412/19 |
| 1214194 | 4/1966 | Germany | 412/21 |
| 3207102 | 9/1983 | Germany | 412/10 |
| 34 13 222 | 10/1985 | Germany . | |
| 412 798 | 11/1966 | Switzerland . | |
| 1425029 | 9/1988 | U.S.S.R. | 269/237 |
| 1532319 | 12/1989 | U.S.S.R. | 412/22 |

*Primary Examiner*—A. L. Pitts
*Assistant Examiner*—Gregory Andoll
*Attorney, Agent, or Firm*—Spencer & Frank

[57] ABSTRACT

A method and apparatus is provided for making books, brochures and similar products with a perfect binding. Signatures are continuously gathered in a specific sequence in a direction of conveyance, to form loose signature blocks. The loose signature blocks are collected by holders that include a mechanism that applies a compression force to the signature blocks. The signature blocks are transferred, with the compression force still applied to the signature blocks, in an approximately perpendicular feeding movement to a circulating clamping arrangement which is driven in the same direction as the direction of conveyance.

16 Claims, 3 Drawing Sheets

METHOD AND APPARATUS FOR MAKING BOOKS, BROCHURES, AND SIMILAR PRODUCTS WITH PERFECT BINDING

CROSS-REFERENCE TO RELATED APPLICATION

This application claims the priority of patent application Ser. No. 03 479/94-6 filed in Switzerland on Nov. 18, 1994, and of patent application Ser. No. 03/781/94-5 filed in Switzerland on Dec. 14, 1994, the disclosures of both applications being incorporated herein by reference.

BACKGROUND OF THE INVENTION

The invention relates to a method of making books, brochures and similar products with a perfect binding, wherein the signatures that are gathered continuously in a specific sequence to form loose signature blocks are transferred to a circulating clamping arrangement, which is associated with a perfect binding device, for the processing and/or the adhesive connection of the fold edges or sheet edges of the signatures so as to form book blocks.

In this technique, the signatures, folded sheets or individual sheets, are gathered or collected in a gathering device, which is connected to an automatic perfect binder, to form loose book blocks or signature blocks in a specific sequence determined by the feeding stations and a feeder control, and they are fed via a transfer channel or a transfer segment to the perfect binder.

Following a stratified gathering of the signatures in the gathering channel of the gathering device, the signatures are transported further with a change of direction of approximately 90°, by means of a turning movement in the transfer channel. Subsequently, placement of the completed signature blocks are placed into a position in which the signatures stand on their folded edges which later form the spine of the book. In this standing position, the signature blocks are fed to the clamping arrangement of the perfect binder, which is made up of collet chucks that are arranged side by side, in which arrangement processing and perfect binding take place. Such processing includes, for example, spine trimming, notching, roughing and cleaning of the processed surface.

At a maximum format height or fold length, for example, of 510 mm, the signature blocks reach a speed of 2.54 m/s in the transfer channel if the target is an hourly production rate of 15,000 copies. Here, the known method reaches an upper physical output limit, i. e., the target of a greater throughput rate cannot be accomplished by increasing the speed.

SUMMARY OF THE INVENTION

It is an object of the invention to create a method of the type mentioned in the introduction which achieves a production rate that is higher than the rate accomplished so far without a loss of quality of the book blocks.

The above and other objects are accomplished in accordance with the invention by a method of making books, brochures and similar products with a perfect binding, comprising: continuously gathering in a direction of conveyance, signatures in a specific sequence to form loose signature blocks; subsequently grasping the loose signature blocks with a mechanism that applies a compression force to the signature blocks; and transferring the signature blocks, with the compression force still applied to the signature blocks, in an approximately perpendicular feeding movement to a circulating clamping arrangement which is driven in the same direction as the direction of conveyance.

By virtue of the invention, the signatures are aligned relative to their fold for further processing and gathered in the direction of conveyance to form signature blocks. The signatures are subsequently grasped by a compression force and, by means of an approximately perpendicular feeding movement, are fed to the clamping arrangement, which is driven in the same direction. This means that the signature blocks are put together from signatures which are placed side by side and extend transversely to the direction of conveyance.

In this manner, considerably shorter gaps are attained during the gathering of the signatures, a higher throughput rate of signature blocks than possible so far, even at a reduced speed, is achieved, and a processing sequence without a disturbing change of direction of the signatures is accomplished.

Furthermore, this method can eliminate a turning for the purpose of placing the loose signature blocks into the standing position in a transfer segment which follows the gathering and, thus, resulting displacements of the signatures can be eliminated.

Advantageously, the signatures are gathered while standing on the fold, which has a favorable effect on their feeding, and they are fed selectively to the clamping arrangement with the open side, the top side or bottom side or the closed side forward (i.e., coming first when fed to the clamping arrangement).

According to a further advantageous feature of the inventive method, the signature blocks are held together after gathering and are fed to the clamping arrangement after they have been turned around the processing edge or book block edge.

The objects of the invention are further carried out by the provision of an apparatus for the production of books, brochures and similar products with a perfect binding, the apparatus including: a gathering device connected upstream of a perfect binder comprised of processing stations, the gathering device collecting signatures along feeder stations according to a specific sequence to form loose signature blocks; and a circulating clamping arrangement connected with the gathering device and extending through the processing stations of the perfect binder, wherein the circulating clamping arrangement includes spaced collet chucks and the apparatus further comprises: a conveying device allocated to the gathering device and forming a common conveying segment with the clamping arrangement; and uniformly spaced holders fastenable on the conveying device and including grasping means for applying a controllable closing force for grasping the signatures, the holders being decouplable from the conveying device and couplable with the collet chucks thereby constituting, alternatingly, partial component parts of the conveying device and of the clamping arrangement.

An efficient supply of signature blocks can thus be accomplished in a simple manner before the signature blocks are processed.

Preferably, the clamping arrangement with the collet chucks is implemented after having taken over the holders with the signature blocks preferably upstream of the processing stations of the perfect binder so that a contamination at the clamping arrangement including the collet chucks and the holders largely can be prevented.

In order to be able to move the signatures during the gathering into signature blocks to the later processing position in the perfect binder, it is another aspect of the invention that mountings, which are co-circulating in parallel, be allocated to the holders along the feeder stations, which mountings receive the signatures. These mountings are fastened to a circulating pulling means which leaves departs from the direction of movement of the holders at the rear side of the feeder stations.

A simple embodiment of the holders includes two walls, which are spaced apart in the direction of conveyance, the spacing being changed because of the different thickness of the signature blocks or for holding the signatures together. At least one wall of the holders is supported against a cancelable spring force while the signatures are being held together, with the force being canceled at the latest when the holders are removed from the book blocks.

According to one embodiment of the holders, the lower end of the walls is configured by a transverse bar which is displaceably arranged on a guide arrangement. The bar has a favorable effect on the stability and the adjustability of the walls.

The collet chucks, in turn, are embodied with two support elements each, which extend transversely to the direction of conveyance and whose spacing can be adjusted. The support elements are provided with at least one positioning device to receive the holders which have been fed a signature block. A clamping jaw is fastened to each support element. At least one of the clamping jaws is manipulable i.e., one of the clamping jaws may be arranged in a stationary manner. The clamping jaws cooperate in a pressing manner with each other behind an overhang for the processing of the book block spine.

Two grooves corresponding with the transverse bars are distributed over the support elements and are suitable as a simple positioning device for the signature blocks.

A reference position to determine the transverse position of a signature block may be provided in the support elements by a pin and a bore that corresponds with the pin.

For the actuation of at least one clamping jaw against the other, with a signature block lying or hanging in between, a controlled plunger arrangement is provided which releases a swing movement of the clamping jaw for the pressing of the signature block.

At least one of the clamping jaws can be force-transmittingly or form-fittingly locked in the pressing position of the clamping jaws as long as the processing process is not yet completed.

For the purpose of opening and closing or for changing the spacing between the support elements, which are fastened on both sides to connecting means that are connected by guided pulling means or pulling means segments, at least one support element is arranged so as to be adjustable and it can be actuated correspondingly by a control device which acts upon it. This is required particularly prior to receiving the holder containing the signature block and during the disposal of the holder from the clamping jaw.

The clamping jaws are preferably guided by rollers, crossheads or similar guide elements which are provided at the point where the pulling means are articulated to the connecting elements or on the latter and which engage a guiding groove of a rack or machine column.

BRIEF DESCRIPTION OF THE DRAWINGS

These and other features and advantages of the method and device of the invention will be further understood from the following detailed description of the preferred embodiments with reference to the accompanying drawings

DETAILED DESCRIPTION OF THE PREFERRED EMBODIMENTS

Referring to FIGS. 1 through 5, there is shown segments of processing stations for the production of books, periodicals, brochures and similar products with a perfect binding.

Figure 1:
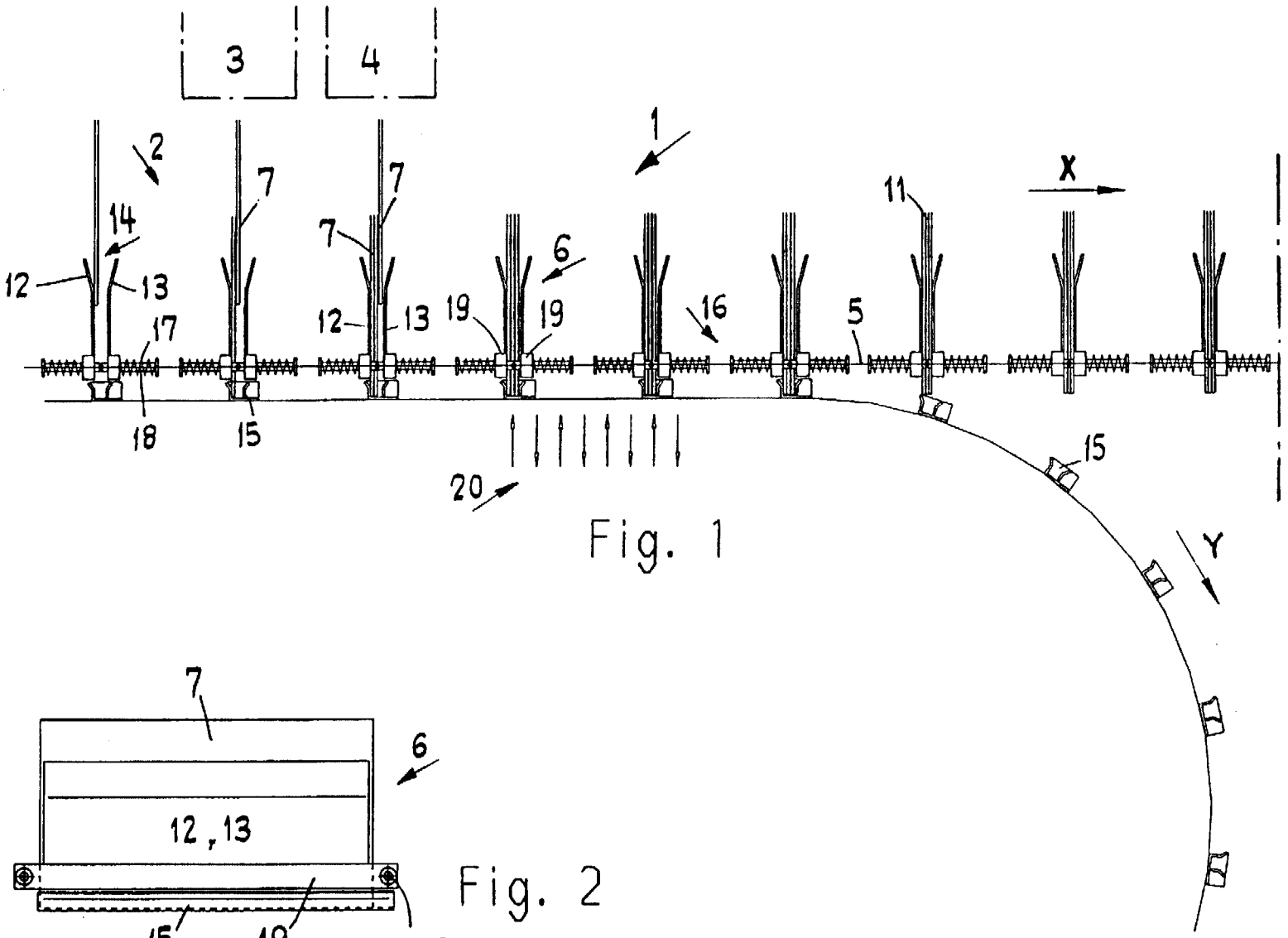
FIG. 1 is a side view of a conveying device at a gathering device.
Figure 3:
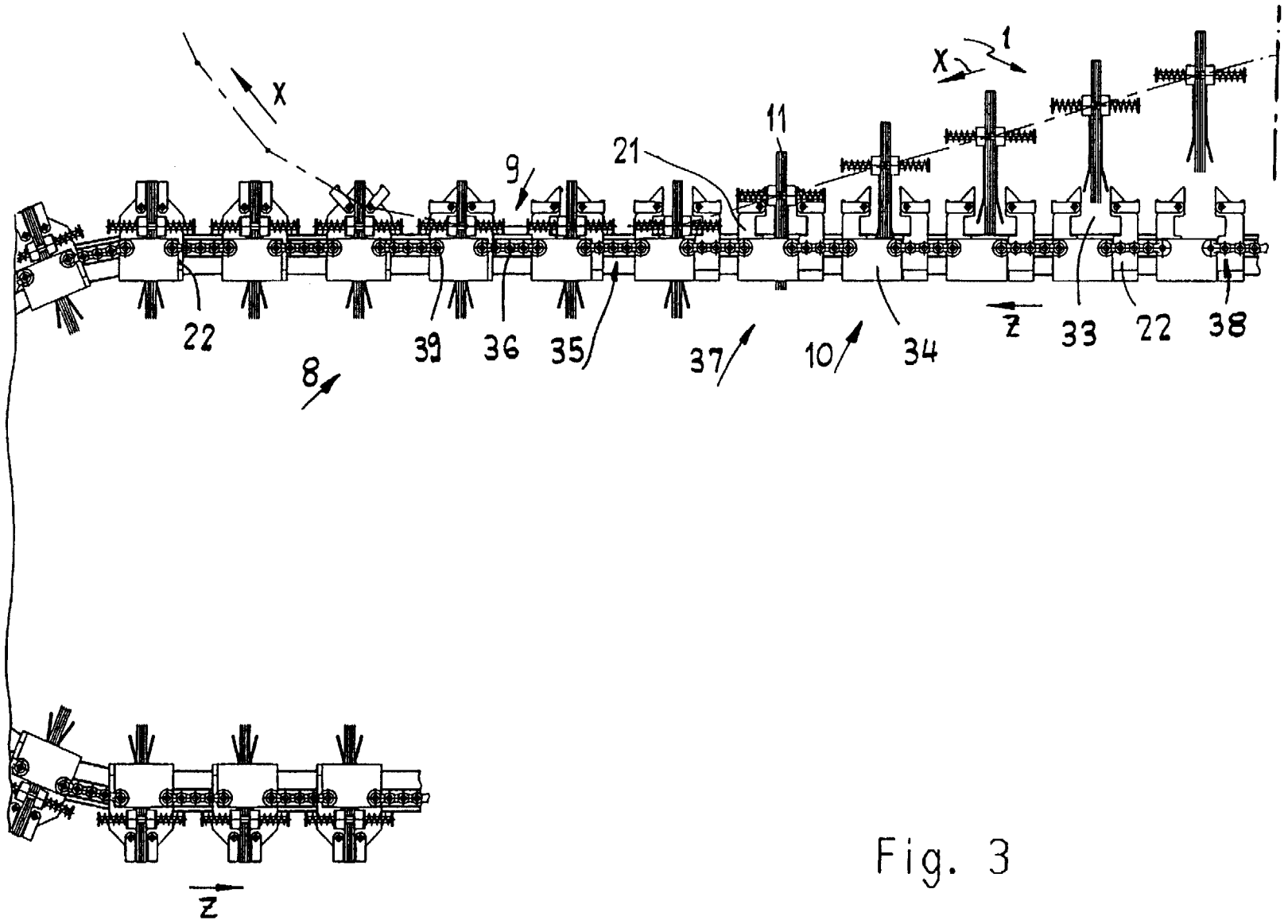
FIG. 3 is a side view of the clamping arrangement of a perfect binder at the intersection with the gathering device.

FIG. 1 illustrates a conveying device 1 of a gathering device 2 along two feeder stations 3, 4. The continuously driven conveying device 1, is configured by holders 6 fastened at uniform distances on a circulating pulling means 5, travelling along a path X which holders are fed with signatures 7 in the same cadence as feeder stations 3, 4. As shown in FIG. 3, conveying device 1 forms a common conveying segment 9 together with a circulating clamping arrangement 8 of a downstream perfect binder, at which conveying segment gathered signatures 7 are transferred to collet chucks 10 of clamping arrangement 8. A transfer of signature blocks 11, which are formed after gathering, to collet chucks 10 may take place from below as well as from the top by means of the collet chucks, with the open sides of signatures 7 of a signature block 11 being fed forward through collet chucks 10.

If signature blocks 11 are fed into collet chucks 10 from the top, as is illustrated, signature blocks 11 must be turned around their processing edge (approx. 180°) before they are fed.

In such a procedure, signature blocks 11 are pressed together in holders 6 so that displacements among signatures 7 do not occur.

Holders 6 at conveying device 1 of gathering device 2 are comprised of two approximately parallel spaced walls 12, 13, which are configured so as to be diverging at a charge opening 14 and which create a receptacle-like shape on the oppositely disposed side by way of mountings 15 which co-circulate in the same direction. Mountings 15, which are allocated to holders 6, are also fastened to a circulatingly driven pulling member 16, which moves away from the movement path X of holders 6 along a path Y at the end of gathering device 2 following the action of a force or spring force on at least one wall 12, 13, so that mountings 15 are moved off the completed signature blocks 11.

The illustrated mountings 15 have a bottom on which signatures 7 are oriented. Instead of a bottom, a guide surface could also be provided over the length of the gathering section, which would extend at least up to the action of the closing force of the holders 6.

FIG. 1 shows pressure springs 17 acting upon walls 12, 13 via transverse supports 19, which springs are guided by guide rods 18. As was already mentioned, it would be possible to act upon a wall 12, 13 from one side by means of springs. The adjustment of the walls 12, 13 takes place by means of a control device which is not illustrated.

Figure 2:
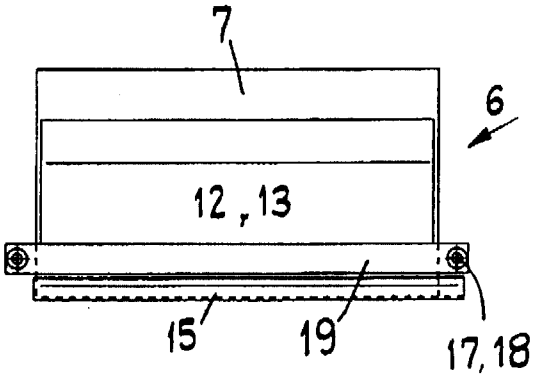
FIG. 2 is a cross section of the conveying device.

FIG. 2 illustrates the configuration of the receptacle-like shape of holders 6 as they cooperate with mountings 15, with the lower edge of walls 12, 13 being embodied with a transverse support 19 to reinforce the walls and to receive pressure spring device 17, 18. At the end of gathering device 2 or immediately following it at the end of the charging, a vibrator device 20 is arranged so that signatures 7 are uniformly lined up in mountings 15 before walls 12, 13 are actuated to form a compressed signature block 11.

As is shown in FIG. 3, signature blocks 11 in holders 6 are transferred to collet chucks 10 of clamping arrangement 8 by pulling means 5 of conveying device 1 on a common conveying segment 9, which is formed of conveying device 1 and clamping arrangement 8 which are driven in the same direction. This is done through a change of the holders 6, which are decoupled from pulling means 5 and placed into collet chucks 10, with the feeding of holders 6 beginning on the side of collet chucks 10 facing the processing stations of the perfect binder (not shown). Each holder 6 thus alternatingly represents a partial component part of gathering device 2 with conveying device 1, and clamping arrangement 8 with collet chucks 10. Signature blocks 11 plunge with the open sides of signatures 7 into collet chucks 10, which are controlled to be in the open position, and there they are fixed in place or anchored in their processing position by a controlled closing movement.

Figure 5:
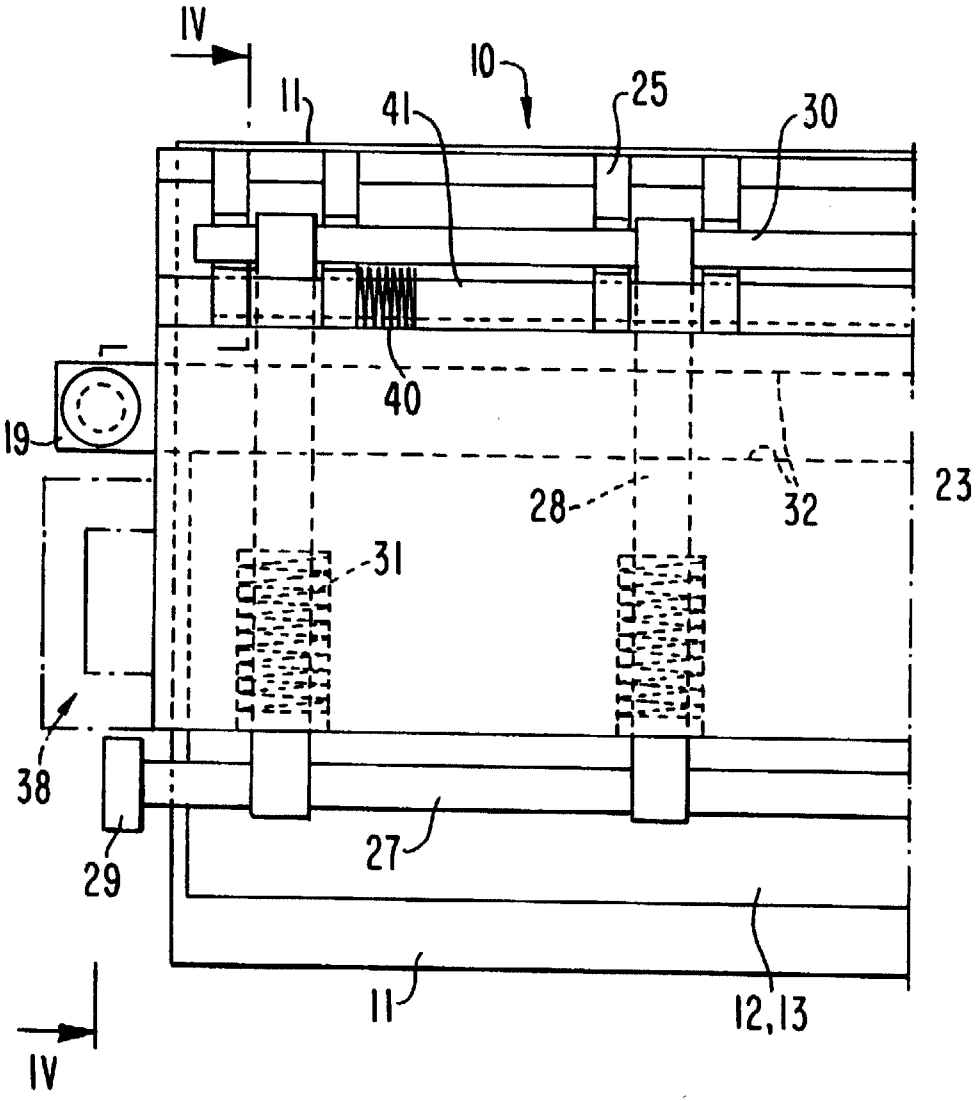
FIG. 5 is a side elevational view of a collet chuck according to FIG. 4.
Figure 4:
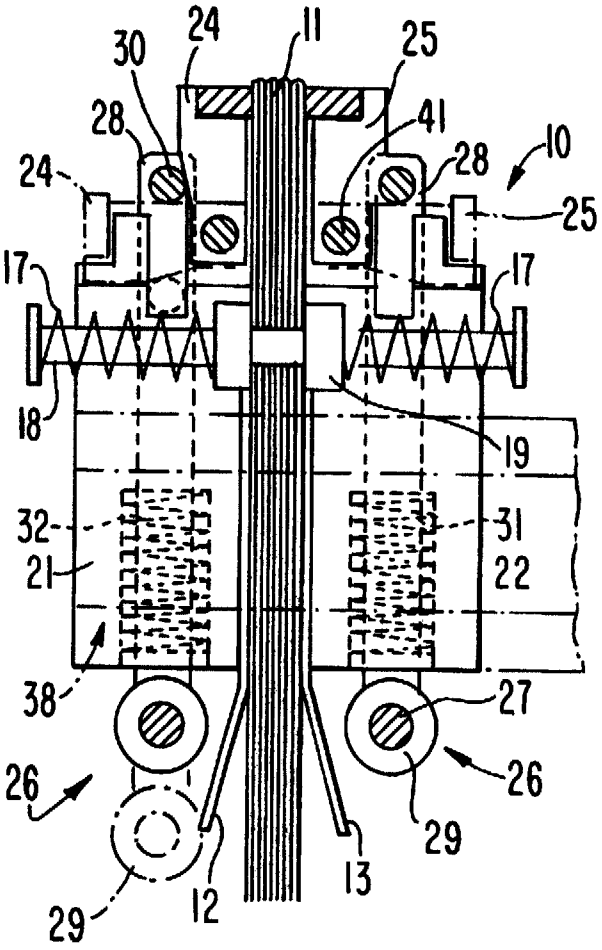
FIG. 4 is a cross section of a collet chuck according to FIG. 5.

For this purpose, each collet chuck 10 is provided with two support elements 21, 22, which extend transversely to the direction of conveyance and whose mutual distance is adjustable in the direction of conveyance such that their inner sides approximately rest against walls 12, 13 of holders 6 without pressing signature blocks 11. Referring additionally to FIGS. 4 and 5, holders 6 with signature blocks 11 are fixed in place in collet chucks 10 in that transverse rods 19 of holders 6 plunge into respective grooves 32 extending transversely in support elements 21, 22 during a closing movement of support elements 21, 22. This position of signature blocks 11 in collet chucks 10 is the reference position for the later processing of signature blocks 11 in the perfect binder. The lateral position of the holders 6 with signature blocks 11 is effected by way of a positioning device 23 shown in FIG. 5.

On the side of collet chucks 10 facing the processing of the signature blocks, support elements 21, 22 are each provided with a clamping jaw 24, 25, of which at least one pressingly cooperates with the other or can be driven, forming an overhang of the signature block 11 intended for processing.

The present embodiment has two clamping jaws 24, 25 swingingly arranged on a shaft 41, and which can be driven against one another by release of a torsion spring 40 arranged on a shaft 41. Clamping jaws 24, 25 are pressed laterally against signature block 11 hung in between by controllable plunger arrangements 26 (as herein described), making it possible to detach clamping jaws 24, 25 from signature block 11 during the processing of signature block 11 in the perfect binder so as to change the overhang.

Plunger arrangements 26, which act on clamping jaws 24, 25, each comprise a plunger 28 seated or secured on a central shaft 27 and are distributed over the width of a respective one of the support elements 21, 22 and guided in the support elements 21, 22. Plunger arrangements 26 are driven by a control device (not shown) by way of a roller 29 secured to the ends of shaft 27. The end of each plunger 28 disposed opposite shaft 27 is connected by a circular rod 30 acting on the respective clamping jaw 24, 25 configured as a lever, which maintains the clamping jaw 24, 25 in the pressing position through a continuous pressure until this is no longer required by the processing of the book block spine.

The plungers 28 are then brought back by way of the rollers 29 running up a control track (not shown), and they are held in their resting position by springs 31 which are built into the support elements 21, 22.

FIG. 3 illustrates the arrangement of support elements 21, 22 of collet chucks 10 within clamping arrangement 8 of a perfect binder. In this embodiment, the respectively trailing support element 22 in the direction of conveyance is guided or arranged to be displaceable with respect to the adjustability of an opening 33 of collet chuck 10 in a connecting element 34 of pulling means segments 35, here link chains 36, of a pulling member 37. The size of opening 33 is changed through the action of a control which opens collet chuck 10 before holders 6 are fed and closes them again prior to their decoupling from pulling means 5. In a different embodiment, both support elements 21, 22 could, of course, be arranged on connecting element 34 so as to be adjustable with respect to changing the opening of the collet chuck.

In the present case, the leading support element 21, however, is fixedly connected to the connecting element 34.

A partially shown run of clamping arrangement 8, travels along a path Z and forms a common conveying section 9, is guided in a lateral guide arrangement 38, with the pulling means segments 35 having a guide roller 39 or a crosshead at the ends that are coupled to connecting elements 34. Guide roller 39 can be seen in FIG. 3 on the side of connecting elements 34 facing the viewer.

The functioning of the device according to the invention is described below, again by way of reference to the figures.

FIG. 1 illustrates the charging of holders 6 of conveying device 1 at gathering device 2. Signatures 7 fed by feeder stations 3, 4 form a signature block 11 which builds itself up in the direction of conveyance. After charging, vibrating device 20 places the signatures against an abutment face in mountings 15, which are co-circulating in the same direction. The signatures are then held together immovably by pressure spring device 17, 18 which applies a compression force to the signature blocks. On their further conveyance path, signature blocks 11 in holders 6 reach a common conveyance segment 9 at clamping arrangement 8 (see FIG. 3). On conveyance segment 9, both conveying device 1 and clamping arrangement 8 with collet chucks 10 have the same speed.

Through decoupling from pulling means 5, holders 6 are transferred to clamping arrangement 8, which is controlled into a closing position on conveying segment 9, so that holders 6 with signature blocks 11 hang fixedly in collet chucks 10. Further on their path, signature blocks 11 are pressed together by actuation of clamping jaws 24, 25 at or ahead of the overhang in that a torsion spring 40 arranged on shaft 41 releases a swing movement of the clamping jaws 24, 25 through the action of a control element so that the clamping jaws rest against the book blocks at the overhang and are subsequently placed into a pressing position by lifting the plungers 28. In this manner the signature blocks are guided through the processing stations of the perfect binder. The removal of the glued book blocks at the end of the perfect binding process takes place by lifting the holders 6 out of the opened collet chucks 10, for instance, at a second common conveying section where the clamping device 8 with collet chucks 10 and pulling means 5 of conveying device 1 meet once again. The removal of the book block then takes place at holder 6.

It will be understood that the above description of the present invention is susceptible to various modifications, changes and adaptations, and the same are intended to be comprehended within the meaning and range of equivalents of the appended claims.

What is claimed is:

1. A method of making books, brochures and similar products with a perfect binding, comprising:

continuously gathering in a direction of conveyance, signatures in a specific sequence to form loose signature blocks;

subsequently grasping the loose signature blocks with a mechanism that applies a compression force to the signature blocks; and transferring the signature blocks, with the compression force still applied to the signature blocks, in an approximately perpendicular feeding movement to a circulating clamping arrangement which is driven in the same direction as the direction of conveyance.

2. The method according to claim 1, wherein the gathering step includes gathering the signatures while standing on a fold and said transferring step includes feeding the signatures to the clamping arrangement with an open side of the signatures opposite the fold introduced first into the clamping arrangement.

3. The method according to claim 2, including feeding the grasped signature blocks to the clamping arrangement after having been turned around a processing edge or book block edge.

4. In an apparatus for the production of books, brochures and similar products with a perfect binding, the apparatus including: a gathering device connected upstream of a perfect binder comprised of processing stations, the gathering device collecting signatures along feeder stations according to a specific sequence to form loose signature blocks; and a circulating clamping arrangement connected with the gathering device and extending through the processing stations of the perfect binder, the improvement wherein:

the circulating clamping arrangement includes spaced collet chucks and said apparatus further comprises: a conveying device allocated to the gathering device and forming a common conveying segment with the clamping arrangement; and uniformly spaced holders fastenable on the conveying device and including grasping means for applying a controllable closing force for grasping the signatures, the holders being couplable with the collet chucks thereby constituting partial component parts of the conveying device and of the clamping arrangement.

5. The device according to claim 4, further comprising mountings co-circulating in parallel with and allocated to the holders along the feeder stations.

6. The device according to claim 5, and further comprising a circulating pulling means to which the mountings are fastened.

7. The device according to claim 4, wherein each holder includes two walls adjustably spaced apart in a direction of conveyance so that the space between the walls can be changed.

8. The device according to claim 7, wherein each holder includes a spring providing a cancelable spring force against which at least one wall of the holder is supported.

9. The device according to claim 8, wherein the walls of the holders each has an end including a displaceably mounted transverse bar.

10. The device according to claim 4, wherein each collet chuck includes two support elements which extend transversely to a direction of conveyance of the clamping arrangement for placement in a processing position in the respective processing stations, the support elements being adjustable for adjusting a spacing therebetween, the support elements including at least one positioning device to receive a respective one of the holders which have been fed a signature block; and two clamping jaws, each clamping jaw being fastened to a respective one of the two support elements, at least one of the clamping jaws being a manipulable clamping jaw which cooperates in a pressing manner with the other jaw behind an overhang of the book block spine that is intended for processing in the perfect binder.

11. The device according to claim 10, wherein each holder has a lower end including a displaceably mounted transverse bar and the at least one positioning device of each collet chuck constitutes a groove in a respective one of the support elements for receiving the transverse bar for setting a processing depth of the book block spine.

12. The device according to claim 10, wherein the at least one clamping jaw is swingably mounted to its support element and each collet chuck further includes a controlled plunger arrangement operatively connected with the at least one clamping jaw for swinging the at least one clamping jaw toward the other clamping jaw into a pressing position with the signature block being disposed between the two clamping jaws.

13. The device according to claim 12, and further comprising means for locking the clamping jaws in the pressing position.

14. The device according to claim 11, wherein at least one of the clamping jaws is adjustable for changing the size of the overhang.

15. The device according to claim 10, wherein the clamping arrangement includes a pulling means comprising pulling segments and connecting elements that are connected by the pulling segments, each collet chuck being associated with a respective one of the connecting elements, with at least one of the support elements of each collet chuck being adjustable with respect to a corresponding connecting element in a direction of conveyance of the circulating clamping arrangement for changing the spacing of the clamping jaws.

16. The device according to claim 15, wherein the pulling segments have ends that are connected with the connecting elements, which ends include a guide roller or a crosshead for engaging a guide arrangement.

* * * * *